US006817864B1

(12) United States Patent
Martinez

(10) Patent No.: US 6,817,864 B1
(45) Date of Patent: Nov. 16, 2004

(54) INFANT MOTOR SKILL DEVELOPMENTAL AID APPARATUS

(76) Inventor: Irene Martinez, 510 Valencia Ave. #7, Coral Gables, FL (US) 33134

( * ) Notice: Subject to any disclaimer, the term of this patent is extended or adjusted under 35 U.S.C. 154(b) by 0 days.

(21) Appl. No.: 10/452,101

(22) Filed: Jun. 1, 2003

Related U.S. Application Data

(60) Provisional application No. 60/384,572, filed on Jun. 3, 2002.

(51) Int. Cl.[7] ..... G09B 19/00
(52) U.S. Cl. ..... 434/258; 446/227
(58) Field of Search ..... 434/258, 259, 434/260; 482/66; 446/227; 472/15, 95, 100

(56) References Cited

U.S. PATENT DOCUMENTS 4,084,273 A * 4/1978 Haynes ..... 5/105
4,773,639 A * 9/1988 Graves ..... 482/66
5,211,607 A * 5/1993 Fermaglish et al. ..... 472/15
5,518,475 A * 5/1996 Garland ..... 482/68
5,538,432 A * 7/1996 Dondero et al. ..... 434/258
5,700,201 A * 12/1997 Bellows et al. ..... 472/103
5,728,030 A * 3/1998 Hsieh ..... 482/66
5,732,999 A * 3/1998 Petrie ..... 297/136
6,000,750 A * 12/1999 Rossman et al. ..... 297/2
6,179,376 B1 * 1/2001 Meeker et al. ..... 297/137
6,540,579 B1 * 4/2003 Gubitosi et al. ..... 446/227
6,682,139 B2 * 1/2004 Bellows et al. ..... 297/136

* cited by examiner

*Primary Examiner*—Kurt Fernstrom
(74) *Attorney, Agent, or Firm*—Yi Li

(57) ABSTRACT

An infant motor skill developmental aid apparatus is disclosed, which includes a support base having a planar top surface and a bottom surface, a top tray having an opening for accepting an infant upper body, and a connection means connected between the support base and the top tray. Further disclosed is a method of assisting infant motor skill development, which includes providing the infant motor skill developmental aid apparatus; placing an infant inside the apparatus through the opening of the top tray and having the infant sitting on the support base with arms on top of the top tray; adjusting the top tray to an appropriate height depending on the infant age; and having the infant playing inside the apparatus for a period of time. The apparatus and the method enhance infant's acquisition of normal motor and early learning skills.

19 Claims, 7 Drawing Sheets

INFANT MOTOR SKILL DEVELOPMENTAL AID APPARATUS

REFERENCE TO RELATED APPLICATION

This application corresponds in subject matter to Provisional Application Ser. No. 60/384,572 filed June 3, 2002, which is herein incorporated by reference in its entirety.

FIELD OF THE INVENTION

The present invention relates to an infant motor skill developmental aid apparatus. More specifically, the invention relates to an activity center having a support base for seating an infant and a top activity tray.

BACKGROUND OF THE INVENTION

The science of motor control evolved in the 1980s to encompass a number of different fields, including neuroscience, psychology, and rehabilitation. Motor skill learning, the process of acquiring motor control, is an integral part of this relatively new science.

There are two types of mechanisms that control the execution of a movement. A feedback or closed-loop type mechanism is one in which sensory information initiates and/or plays a direct role in the coordination of the movement. This type of mechanism is used for initial acquisition of a skill. The development of skills which involve eye-hand coordination utilizes this type of mechanism. The feedforward or open-loop mechanism may use sensory information prior to the movement and for evaluation after the movement. Both mechanisms are used in motor control. During the first year of life, a baby often performs new skills slowly and deliberately, using more feedback processes.

It has been stated that ultimate goal of physical motor development is to make the human organism as independent of gravity as is possible within the limitations of the human body. For babies to engage in their world and to environment, it means that they have to become independent. Every since birth it is the babies determination to develop the necessary motor skills that enables him/her to better relate with his/her environment. Consequently: infants who are able to master the motor skill of sitting up unaided gain a totally different view of the environment surrounding them to those who have not mastered that skill and are reliant on aids and parents/care givers to prop them up. Better yet the infant who has mastered the walking process is better equipped to interact with their environment; they can even start to converse and socialize with it, by pointing and pulling people to where they want to go.

It is also important to realize that there are other developmental techniques at play when children engage in motor development. Any task or movement is going to involve motor development skills, the child's perception of his/her environment and prior experiences, cognitive/metacognition, at performing the task or movement.

The following is what motor development occurs in infancy:

| Motor Skill | Average Age Achieved | Age Range Within Which Achieved by Most Infants |
|---|---|---|
| Holds head erect and steady when held upright | 7 Weeks | 3 Weeks–4 Months |
| When prone, elevates self by arms | 2 Months | 3 Weeks–4 Months |

-continued

| Motor Skill | Average Age Achieved | Age Range Within Which Achieved by Most Infants |
|---|---|---|
| Rolls from side to back | 2 Months | 3 Weeks–4 Months |
| Rolls from back to side | 4.5 Months | 2–7 Months |
| Grasps cube | 3 Months, 3 Weeks | 2–7 Months |
| Sits alone, good coordination | 7 Months | 5–9 Months |
| Crawls | 7 Months | 5–11 Months |
| Pulls to stand | 8 Months | 5–12 Months |
| Uses pincer grasp | 9 Months | 7–9 Months |
| Plays pat-a-cake | 9 Months, 3 Weeks | 7–15 Months |
| Stands alone | 11 Months | 9–16 Months |
| Walks alone | 11 Months, 3 Weeks | 9–17 Months |

The present invention is particularly related to the ages when the infants are learning sitting, crawling and walking. At three months, usually the infant can hold the head upright in sitting, although support is needed around the thorax because postural control of the trunk has not yet developed sufficiently in an upright position. Initially the spinal extensors activate from the lumbosacral area progressively upward, but the contractions are not sustained nor balanced by flexor activity. Consequently, the baby maintains an upright position briefly at first; however, the duration of holding rapidly increases throughout the month.

It is common that infants have shoulder elevation with humeral extension and elbow flexion during the third month in sifting as the infant learns to control the head and trunk, as shown in FIG. 1. The pelvis and lower extremities do not actively work off the surface and, therefore, do not provide an adequate base of support. Babies this age sit upright infrequently, although they can sit for long periods of time semi-reclined in an infant seat or swing. The back of the seat continues to function as a surface they can push against, providing stability for head and extremity movements. They may try to pull themselves to a more upright sitting position using abdominals, pectorals, and neck flexors, but cannot move their center of gravity forward over the hip join. Motivated by visual stimulation, they play with their developing head control, lifting the head off the support, holding, and turning it.

The four-month-old infant sits upright for 10 to 15 minutes at a time, usually on someone's lap, and requires support only at the lower trunk or can now be held by the hands, as illustrated in FIG. 2. This increased ability to sit upright indicates several developmental changes. Biomechanical aspects are altered as a greater range of hip external rotation/abduction is available, providing a more stable base of support. The upper extremity pattern of shoulder elevation, humeral extension, and elbow flexion is rarely seen in sifting as the infant can control a larger number of joints and joint motions. Practicing control of the body over the hips, the baby attempts to lean forward to teach or touch an object and return to an erect position. However, postural control has not developed sufficiently to prepare or support the movement so the adult holding the infant stabilizes the trunk or pelvis and assists the infant in coming back to upright. Therefore, sitting erect in a seat without support is not yet functional as the baby slides with attempts to move and reach.

By five months, the hips externally rotate and abduct so the lateral side of the knees can almost touch the surface, providing a larger base of support. The base of support is now more stable, allowing greater active control of the trunk. Bringing the arms down and forward and requiring only minimal or intermittent support, the baby begins to prop on the hands. Sometimes the baby plays with the developing sitting balance, carefully trying to lift one hand to reach or play. At other times, the baby thrusts the body backward or leans far over to the side, challenging the responses of the adult holding the baby. Enjoying an upright view of the world, the baby uses the trunk and pelvic control to sit erect in a variety of seats, which include a bounce-type chair or walker, high chair, stroller, bath seat, and shopping cart. These give the infant different situations for learning to adapt postures and movements for functional activities.

Commercially available baby walkers are designed with the intent of helping babies to learn motor skills more quickly. Baby walkers are wheeled seats that allow a baby's feet to touch the floor and move the walker around. Recent research has shown that baby walkers are not useful for encouraging walking and other skills. In one study, researchers surveyed the parents of 190 infants on baby walker use and developmental milestones. The study found that the 102 babies who used the devices were, as a group, slower to start crawling, standing alone and walking alone. For example, infants who used walkers stood on their own around the age of 13 months, on average 3 to 4 weeks later than those who didn't use-walkers. The researchers further found that the more babies used their walkers, the greater the developmental delay. With each 24 hour increase in walker use, both walking alone and standing alone were delayed by more than 3 days.

Using the baby walker, the baby sits on a hanging seat with feet on the floor. With such a body position, it can cause over extension of the infant's spine and under utilization of abdominal muscles, which results in unbalanced body development, thereby delaying an infant's walking and development of other body functions. Some medical experts further concern that prolonged use of baby walkers and unbalanced body development could render the grown-ups more prone to spinal injuries.

Therefore, it is apparent that there exists a need for apparatuses which can appropriately support- and enhance the infant motor skill development process.

SUMMARY OF THE INVENTION

In one aspect, the present invention relates to an infant motor skill developmental aid apparatus. The apparatus comprises a support base having a planar top surface and a bottom surface; a top tray having an opening for accepting an infant upper body, without a hanging seat; and a connection means connected between the support base and the top tray. Preferably, the support base and the top tray have a circular periphery, and the connection means comprises a plurality of legs connect near peripheries of the support base and the top tray.

In one embodiment, the support base is larger in diameter than the top tray, and the plurality of legs are inclined. The apparatus further comprises a pair of pivotal means at connection points between ends of each of the plurality of legs and the top tray and the support base; and an adjustment means on each of the plurality of legs for adjusting a height of the top tray.

The infant motor skill developmental aid apparatus can further comprise toys mounted on the top tray, or can comprise an exchangeable activity tray adaptable to the top tray.

The apparatus of the present invention can further comprise a removable base attached to the bottom surface of the support base. The removable base has a curved bottom surface enabling a rocking movement of the apparatus. The removable base can also have a plurality of foldable anchoring feet connected to the removable base near periphery, and when the foldable anchoring feet are in an unfold position, the foldable anchoring feet are on the ground supporting the support base in a stationary position. Alternatively, the support base can have a curved bottom surface for rocking and can have a plurality of foldable anchoring feet. The apparatus can further include a fasting means at the opening of the top tray for maintaining the infant at the opening, and cushioning means around the opening of the top tray.

In another embodiment, the diameters of the support base and the top tray are the same, and the plurality of legs are straight in an upright position.

In a further aspect, the present invention relates to a method of assisting infant motor skill development. The method comprises the steps of providing the infant motor skill developmental aid apparatus; placing an infant inside the apparatus through the opening of the top tray, and having the infant sitting on the support base with arms above the top tray and legs laid on top of the support base; adjusting the top tray to an appropriate height according to the infant's age and motor control ability, and having the infant playing inside the apparatus for a period of time. The method further comprises providing learning items on the top tray for the infant, the learning items being selected to be appropriate for the infant age.

It is an object of the present invention to provide an apparatus which promote an infant's early motor and learning skill development.

It is a further object of the present invention to provide apparatus which can be adjusted for different size and age of infants.

It is another object of the present invention to provide a method of assisting an infant's motor skill development, which resembles therapeutic training, but does not require personal assistance.

The above and yet other objects of the present invention will become apparent from the hereinafter set forth Detailed Description of the Invention and claims appended herewith.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 3:
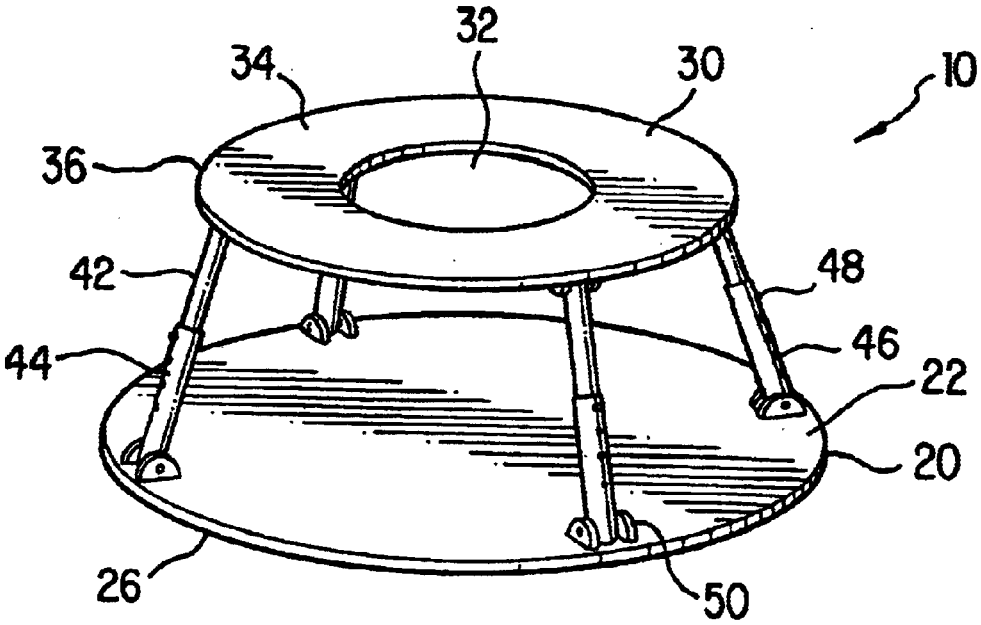
FIG. 3 is a perspective view of an infant motor skill developmental aid apparatus of one embodiment of the present invention.

In one embodiment, the present invention relates to an infant motor skill developmental aid apparatus. As shown in FIG. 3, the infant motor skill developmental aid apparatus 10 comprises a support base 20 which has a top surface 22 and a bottom surface; a top tray 30 which has an opening 32 for accepting an infant upper body, without a hanging seat; and a connection means comprising a plurality of legs 40 connected between support base 20 and top tray 30. Preferably, both support base 20 and top tray 30 have a circular periphery 26 and 36, respectively.

The top surface 22 of the support base 20 is used for seating an infant, and is preferably planar. The support base 20 is made of a firm material, such as rigid plastics, wood, metal, and other suitable materials. When an infant is placed inside the apparatus 10 through the opening 32, the infant's buttocks are on the support base 20 with the legs laid on top of the support base 20, and the infant's upper body is inside the opening 32. Preferably, the opening 32 is in a circular shape, however, it can also be in an oval, square, rectangular, and other suitable shapes. The size of the opening 32 can vary depending on the age and size of the infant. Since the infant's upper body will be in contact with the periphery of the opening 32, the infant motor skill developmental aid apparatus 10 can further include a cushion means around the opening 32 to provide a soft contact around the infant. The cushion means can be fabric, inflated plastics, foam filled liners and other suitable materials. Optionally, the apparatus 10 can also include cushion means placed on top of the support base 20 and the top tray 30.

Furthermore, the infant motor skill developmental aid apparatus 10 can additionally include a fasting means attached to the periphery of the opening 32. The fasting means maintains an infant's upper body inside the opening 32 and prevents the infant sliding down or climbing up to the top tray 30. Suitable examples of fasting means include belt, chain, vest, harness, and other suitable materials. Moreover, additional fasting means can be provided on the support base 20.

As shown in FIG. 3, the support base 20 has a larger diameter than that of the top tray 30. A larger support base provides a more stable structure of the apparatus 10. The plurality of legs 40 are connected to the support base 20 and the top tray 30 near periphery 26 and 36. Because of the difference in diameter between the support base 20 and the top tray 30, upper end of legs 40 are inclined toward the center of the apparatus 10. In this embodiment, bottom surface of the support base 20 is planar. In the apparatus 10 is placed on the floor, the flat bottom surface sets the apparatus 10 in a stationary position.

FIG. 3 shows four legs 40 connected between the top tray 30 and the support base 20. However, it is also feasible to have two, three, or more than four legs. If a hardy material, such as metal, is used to construct the apparatus 10, the connection means can also be one leg to support the top tray 30. Preferably, legs 40 are adjustable in length, so that the height of the top tray 30 can be adjusted as needed for infants of different sizes, or for different levels of motor skill development. Each leg 40 has an adjustment means which enables the leg length adjustment. FIG. 3 illustrates one type of adjustment means. As shown, each leg 40 has an upper portion 42 and a lower portion 44, which are interconnected telescopically. On the lower portion 44, there are a plurality of openings 46. On the upper portion 42, there is a compressible button 48, which matches the size of openings 46, and can extrude from openings 46 to lock the upper portion 42 at a fixed position. Other suitable adjustment means can also be used for the purpose of the present invention, provided that it does not offset the safety of the infant, such as extruded bolts and nuts.

Figure 4:
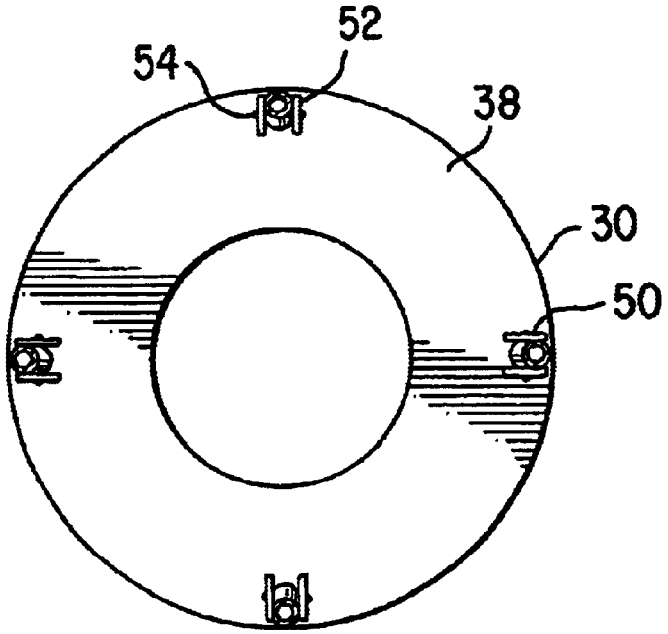
FIG. 4 is a bottom view of the top tray connected with a plurality of legs.

Since the legs 40 are inclined, to provide the adjustability of legs 40 there is also a pivotal means 50 at each end of leg 40. FIGS. 3 and 4 illustrate one type of pivotal means which includes a bracket 52 mounted on the top surface 22 of the support base 20, or the bottom surface 38 of top tray 30, and a pin 54 which inserts through the bracket 52 and the leg 40. FIG. 4 shows the connection of the upper end of the upper portion 42 of the leg 40 with the pivotal means 50. The exterior of the legs 40 can be circular, square, rectangular or other suitable shapes. The dimension of the legs 40 can vary so long it provides a strong support of the structure of the apparatus 10.

Figure 5:
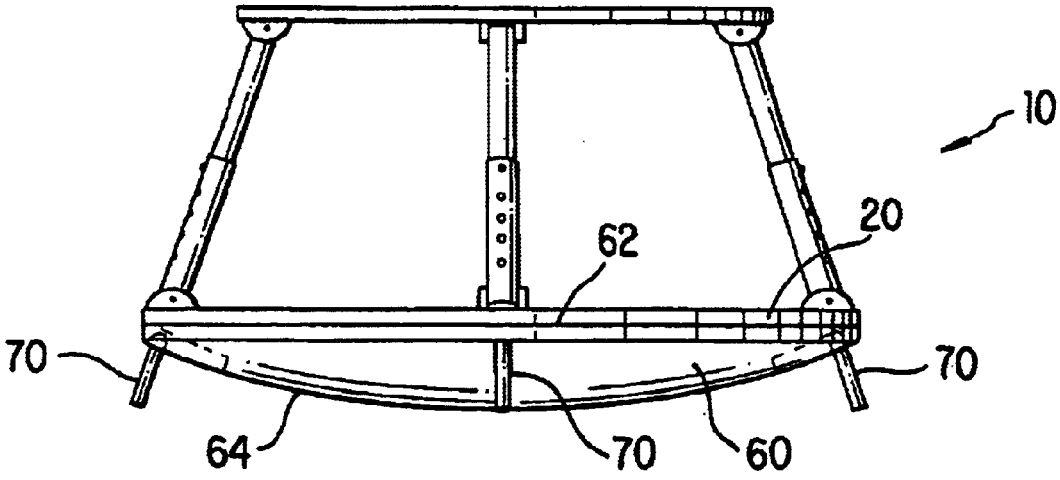
FIG. 5 is a side view of the apparatus of FIG. 1 with a removable base attached to the support base, wherein the removable base has a plurality of foldable anchoring feet.
Figure 6:
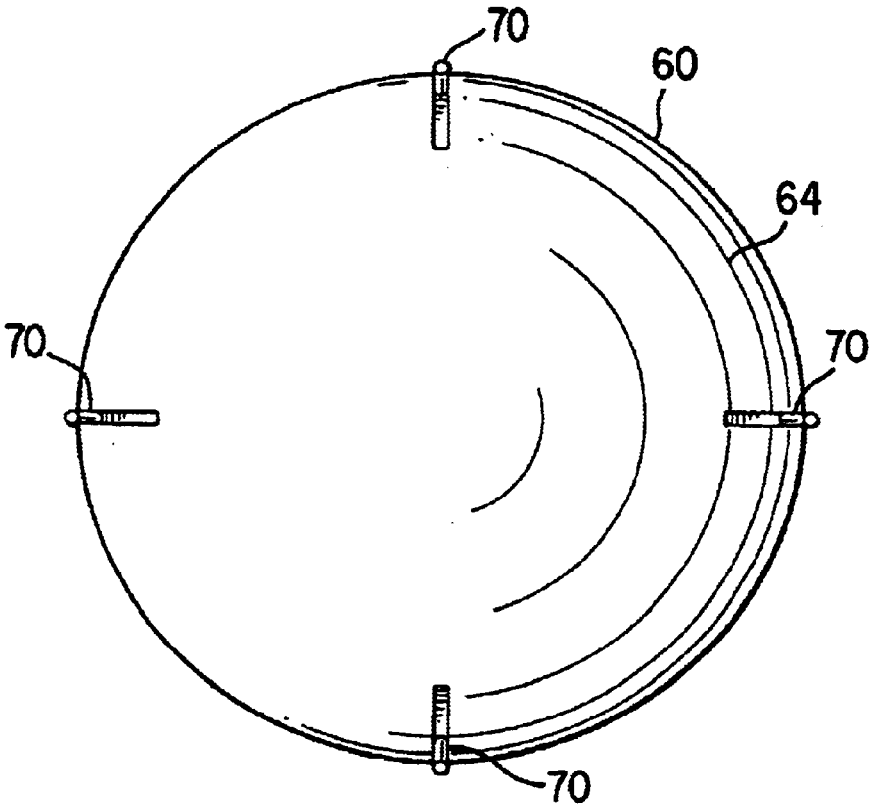
FIG. 6 is a bottom view of the removable base of FIG. 3.

In a further embodiment of the present invention, the infant motor skill developmental aid apparatus 10 further comprises a removable base 60 attached to bottom surface of support base 20, as shown in FIG. 5. The removable base 60 has a planar top surface 62 matching the bottom surface of support base 20, and a curved bottom surface 64. The curved bottom surface 64 enables the apparatus 10 to have an optional rocking motion. The removable base 60 can also include a plurality of foldable anchoring feet 70 near the periphery of the removable base 60. When the foldable anchoring feet 70 are in an unfolding position, the apparatus 10 is in a steady position. When the foldable anchoring feet 70 are in a folding position, the apparatus 10 can be rocked. With the curved bottom surface and foldable anchoring feet, the apparatus 10 can provide different functions depending on a user's need.

Although the above-described curved bottom surface and foldable anchoring feet are provided in the removable base 60, the same structural components can also be directly provided at the bottom surface of support base 20. In other words, the apparatus 10 shown in FIG. 3 can have a curved bottom surface of support base 20 and foldable anchoring feet attached thereto near the periphery of support base 20.

Optionally, the infant motor skill developmental aid apparatus 10 can have wheels connected to the bottom surface of the support base 20, which enables a convenient movement of the apparatus. The wheels can either be foldable or fixed.

Figure 7:
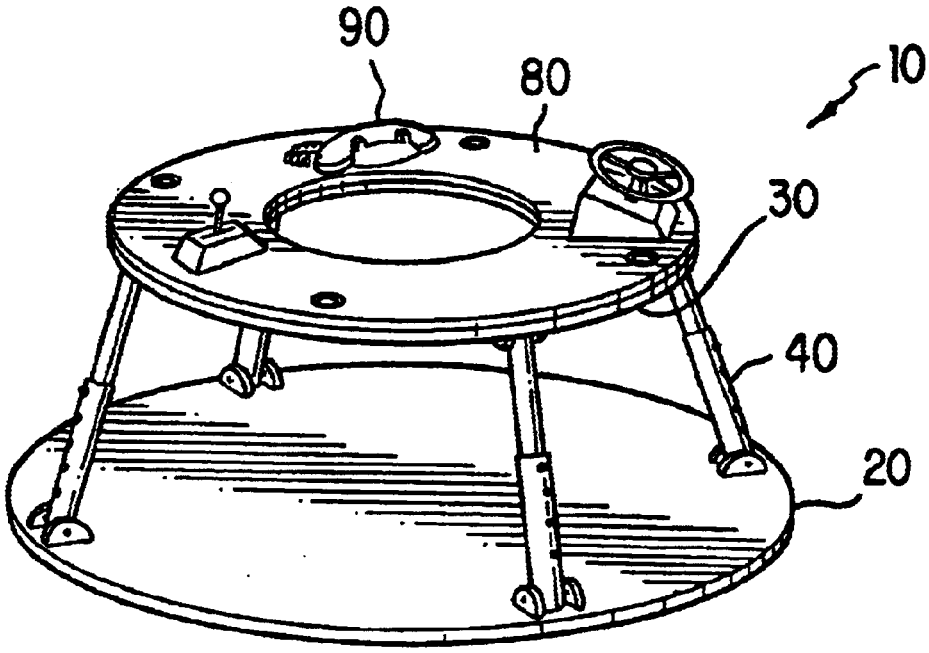
FIG. 7 is a perspective view of the apparatus of FIG. 1, wherein an exchangeable activity tray is attached to the top tray.

In another embodiment of the present invention, the infant motor skill developmental aid apparatus 10, as shown in FIG. 7, further comprises an exchangeable activity tray 80 which is adaptable to the top tray 30, and connection means (not shown) for connecting the exchangeable activity tray 80 to the top surface 34 of the top tray 30. The exchangeable activity tray 80 has a planar bottom surface which can be directly placed on the top tray 30, and preferably has a matching size and opening to the top tray 30. There are numbers of toys 90 that can be connected to the top surface of exchangeable activity tray 80. The exchangeability extends the utility of the apparatus 10 as an infant grows and provides appropriate toys for different levels of learning objectives. It is apparent that pre-attached toys can also be directly provided on the top tray 30 without the additional activity tray 80. The position, including height and orientation, of particular toys, or activities are dependent on learning objectives for a particular age level, and can vary accordingly.

Figure 8:
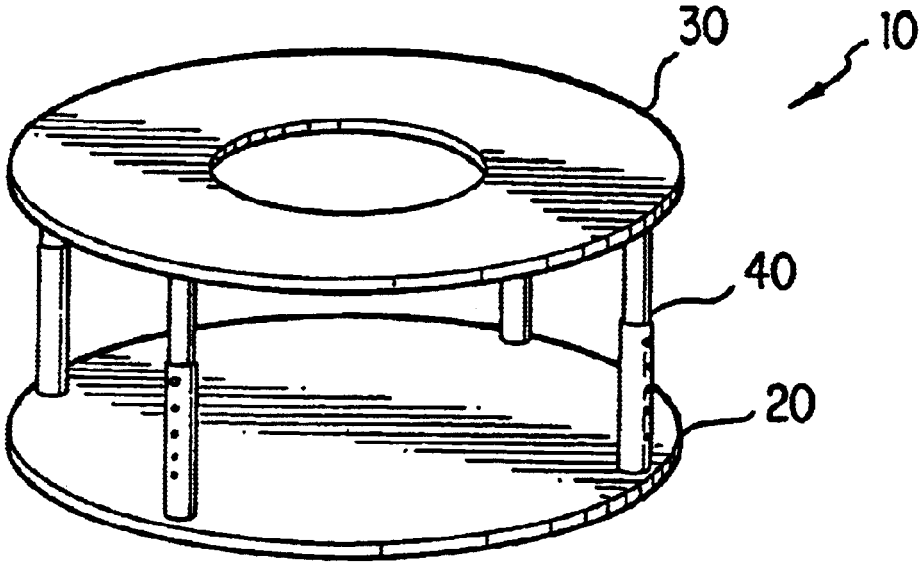
FIG. 8 is a perspective view of an infant motor skill developmental aid apparatus of a further embodiment of the present invention, wherein the adjustable legs are in straight upright position.

FIG. 8 illustrates an alternative embodiment of the infant motor skill developmental aid apparatus 10, wherein the top tray 30 and support base 20 have substantially the same diameter and the plurality of legs 40 are in a straight upright position. The legs 40 are adjustable in length. In this structure, no pivotal means is needed for adjusting the height of the top tray 30.

The support base 20, top tray 30, legs 40, removable base 60 and exchangeable activity tray 80 can be made of rigid plastics, metal, wood, and other suitable materials.

Figure 9:
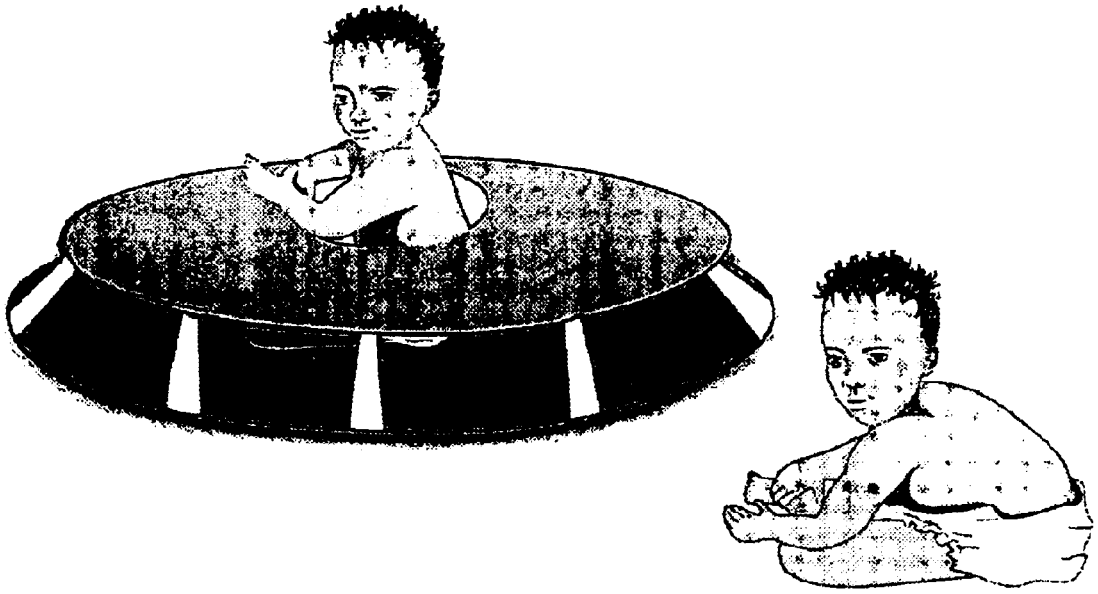
FIG. 9 is an illustrated view of the use of the infant motor skill developmental aid apparatus of the present invention with an infant sifting inside the apparatus, wherein the top tray is adjusted to a height about nipples of the infant.

In an additional embodiment, the top tray 30 further extends downwards to form a dome shape and connects to the support base 20 (not shown). In this case, the connection means can be one continuous curved piece or several curved connection panels. When in use, an infant is placed in the apparatus 10, with the infant's buttocks sitting on the support base 20, the upper body inside the opening 32, with the arms on the top tray 30, and legs laid on top of the support base 20, as illustrated in FIG. 9. The height of the top tray 30 should be adjusted according to the infant's age and the purpose of motor skill training.

Figure 1:
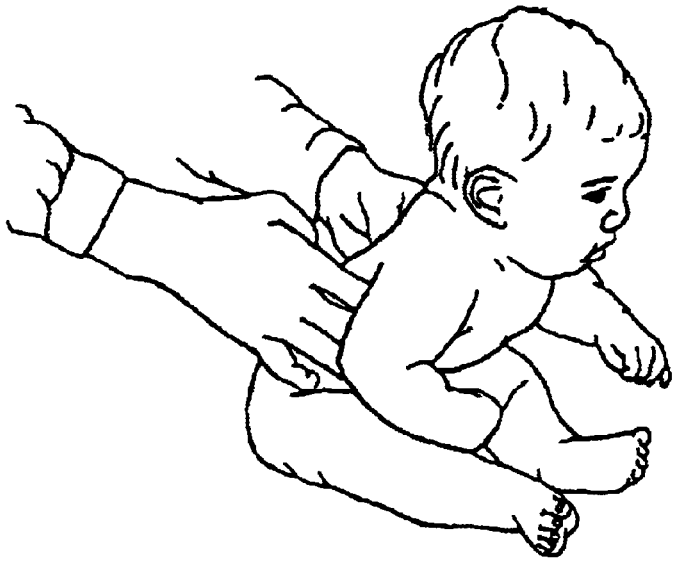
FIG. 1 is an illustration of a three month old infant in a sitting position with assistance from an adult.
Figure 2:
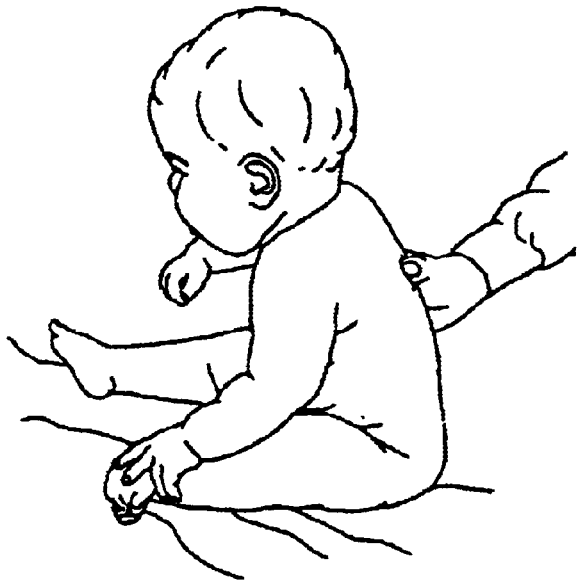
FIG. 2 is an illustration of a four month old infant in a sitting position with reduced assistance from an adult.

At the age about four month old, the height of the top tray 30 should be adjusted to the position of the infant's nipples. The support provided by the top tray 30 facilitates the infant's sitting, and the infant's pushing on his or her arms against the top tray 30 develops the muscles for upright posture. At this age, an infant's muscles are not fully developed yet. Without support, an infant's upper body tends to fall either forward on top the infant's legs, as shown in FIGS. 1 and 9, or fall back or aside on the floor. By leaning the arms against the top tray 30 for support, an infant can stay in a sitting up position for a period of time, playing with toys provided on the top tray. Visual attention and upper extremity skills are developed through therapeutic use of toys or activities. Such activities performed through the aid of the apparatus 10 of the present invention promote an infant's early learning. Otherwise, the infant's interest and attention are not sustained because of his or her physical struggles for maintaining the body position. The position, including height and orientation, of the toys at this stage is critical as vision guides the postural responses the infant makes.

Figure 10:
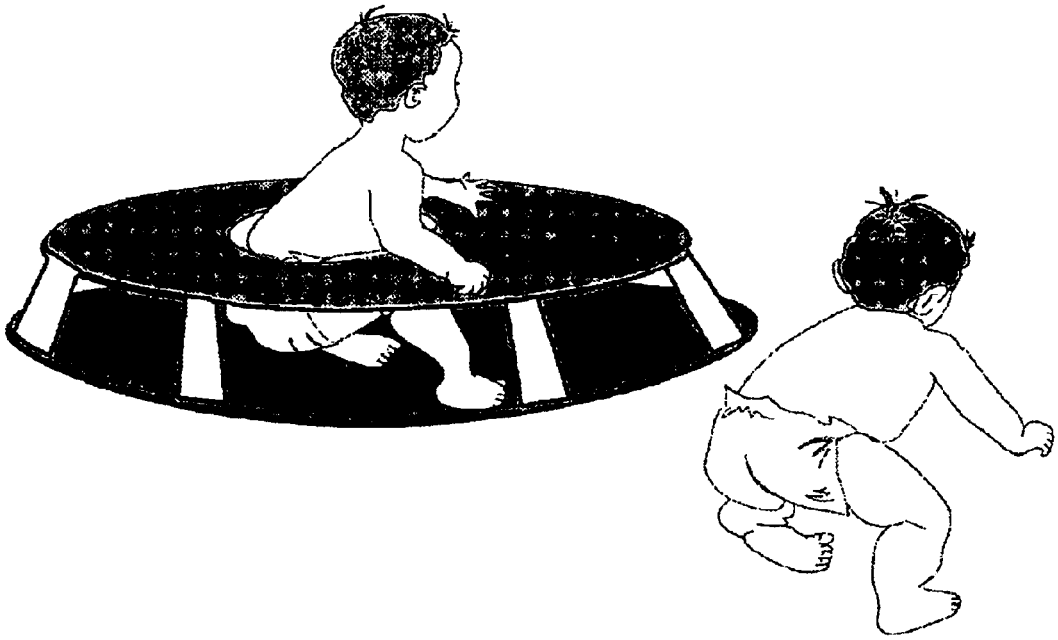
FIG. 10 is a further illustrated view of the use of the apparatus of the present invention, wherein the top tray is adjusted to a height about the waist of the infant.
Figure 11:
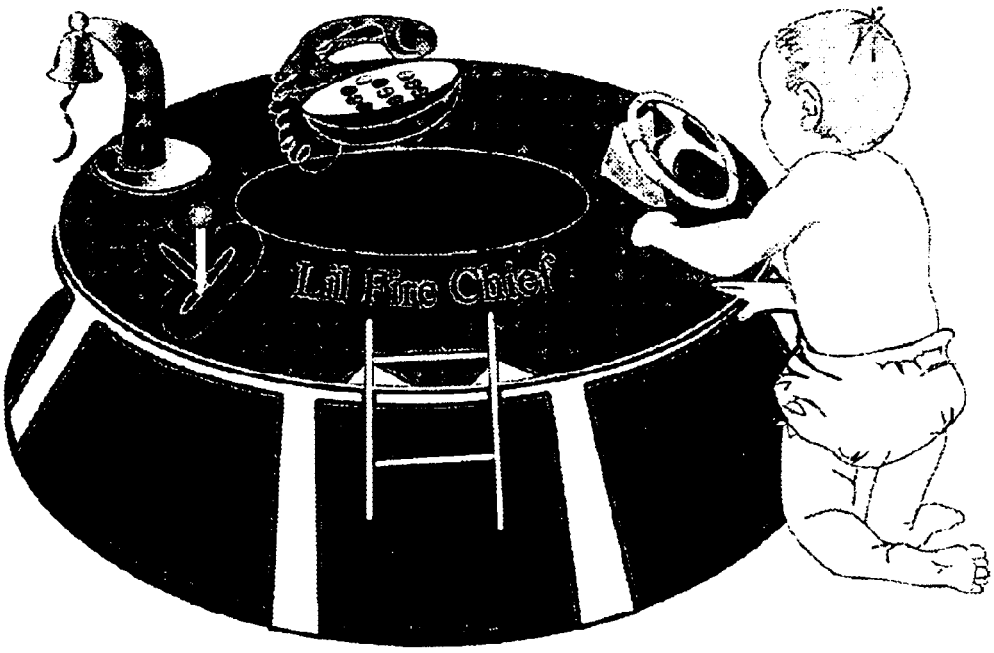
FIG. 11 is another illustrated view of the use of the apparatus of the present invention.

For infant age from 6 to 10 months, the height of the top tray 30 can be adjusted to the height of the infant's waist, as shown in FIG. 10. The support and the activities performed at this position build the muscles needed for crawling as illustrated in FIG. 10. For infant age from 10 to 14 months, the height of the top tray 30 can be adjusted to the height of the infant's chest in a standing position. The support and activities performed at this position build the muscles needed for standing and walking. At this stage, the height of the top tray 30 can vary in a broad range. The infant can also use the apparatus 10 from outside, as shown in FIG. 11. Furthermore, at the stage, the infant can also push forward the wheeled apparatus 10, and use the apparatus 10 as a support for learning walking. When used as a push table, the apparatus 10 also provides opportunities for increasing the infant's abdominal control, and antigravity muscle strength.

As illustrated by the examples shown in FIGS. 9 to 11, the infant motor skill developmental aid apparatus of the present invention promotes an infant's early motor skill development. It is important to understand that a fundamental structural element of the apparatus of the present invention is the support base, which provides an adequate base support for the infant's body, and facilitates healthy and balanced muscle activities. With such a support, the infant can naturally achieve the control of their upper body. This is fundamentally different from prior art's walker type of products, which hangs an infant's buttocks on a suspension support. Such a body position rendered by sitting in a walker can cause over extension of the infant's spine and under utilization of abdominal muscles, which results in unbalanced body development, thereby delaying an infant's walking and development of other body functions.

It is important to point out that the body position and activities supported by the apparatus of the present invention are similar to those provided by a pediatric physical or occupational therapist through the graded support of the therapist's hands in assisting infant's natural motor skill development. Therefore, the apparatus of the present invention provides an effective means for assisting infant's motor skill development, which does not require personal assistance.

Because of the adjustability of the height of the top tray 30, the apparatus 10 works naturally with each baby's own strength and capabilities, and supports each baby to develop at his or her own speed. With the appropriate height of the apparatus, the baby is encouraged to progress naturally unto the next stage of development. Therefore, this is like having the hands of a therapist to guide the baby to move in an appropriate way.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. An infant motor skill developmental aid apparatus comprising:

(a) a firm support base having a planar top surface for seating an Infant thereon and a bottom surface;

(b) a top tray having an opening for accepting an infant upper body, wherein said top tray has no seat associated therewith; and (c) adjustable connection means connected between said support base and said top tray for adjusting a height of said top tray from about the waist to about the chest of an infant silting on said support base.

2. The infant motor skill developmental aid apparatus of claim 1, wherein said adjustable connection means comprise a plurality of adjustable legs connected near peripheries of said support base and said top tray.

3. The infant motor skill developmental aid apparatus of claim 2, wherein said support base and said top tray have a circular periphery, and said support base is larger in diameter than said top tray, and said plurality of legs are inclined.

4. The infant motor skill developmental aid apparatus of claim 3, wherein said apparatus further comprises a pair of pivotal means at connection points between ends of each of said plurality of legs and said top tray and said support base; and an adjustment means on each of said plurality of legs for adjusting said height of said top tray.

5. The Infant motor skill developmental aid apparatus of claim 4, wherein an upper portion and a lower portion of said plurality of legs are interconnected telescopically.

6. The infant motor skill developmental aid apparatus of claim 2, wherein diameters of said support base and said top tray are the same, and said plurality of legs are straight in an upright position.

7. The infant motor skill developmental aid apparatus of claim 2 further comprising toys mounted on a top surface of said top tray.

8. The infant muscle developmental aid apparatus of claim 2 further comprising an exchangeable activity tray adaptable to said top tray.

9. The infant motor skill developmental aid apparatus of claim 2, wherein said bottom surface of said support base is planar.

10. The infant motor skill developmental aid apparatus of claim 9 further comprising a removable base attached to said bottom surface of said support base.

11. The Infant motor skill developmental aid apparatus of claim 10, wherein said removable base has a curved bottom surface enabling a rocking movement of said apparatus.

12. The infant motor skill developmental aid apparatus of claim 11, wherein said removable base has a plurality of foldable anchoring feet connected to said removable base near periphery, and when said foldable anchoring feet are in an unfold position, said foldable anchoring feet are on the ground supporting said support base in a stationary position.

13. The infant motor skill developmental aid apparatus of claim 2, wherein said bottom surface of said support base has a curved surface enabling a rocking movement of said apparatus.

14. The infant motor skill developmental aid apparatus of claim 13 further comprising a plurality of foldable anchoring feet connected to said bottom surface near said periphery, wherein when said foldable anchoring feet are in an unfold position, said foldable anchoring feet are on the ground supporting said support base in a stationary position.

15. The infant motor skill developmental aid apparatus of claim 2 further comprising a fasting means for maintaining said infant at said opening.

16. The infant motor skill developmental aid apparatus of claim 2 further comprising cushioning means around said opening of said top tray.

17. An infant motor skill developmental aid apparatus comprising:

(a) a circular support base having a planar top surface and a bottom surface;

(b) a circular top tray having an opening for accepting an infant upper body, said top tray being smaller in diameter than said support base; wherein said top tray has no seat associated therewith; and (c) a plurality of adjustable legs connected between said support base and said top tray, configured to adjust a height of said too tray from about the waist to about the chest of an infant sitting on said support base.

18. A method of assisting infant motor skill development comprising the steps of:

(a) providing an infant motor skill developmental aid apparatus comprising a firm support base; a top tray having an opening for accepting an infant upper body; and adjustable connection means connected between said support base and said top tray, (b) placing an infant inside said apparatus through said opening of said top tray, and having said infant sit on said support base with arms placed on top of said top tray and with said infant's legs laid on said support base, (c) adjusting said top tray to an appropriate height from about the waist to about the chest of said infant, depending on motor control level of said infant, and (d) having said infant play inside said apparatus for a period of tim .

19. The method of assisting infant motor skill development of claim 18 further comprising providing learning items to said infant on said top tray, wherein said learning items are selected to be appropriate for an age of said infant.

* * * * *